United States Patent [19]

Ridgley

[11] Patent Number: 4,780,189

[45] Date of Patent: Oct. 25, 1988

[54] ELECTRONIC CONTROL CIRCUIT FOR A CATHODIC PROTECTION SYSTEM

[76] Inventor: Gary Ridgley, 5207 Coldstream, Sylvania, Ohio 43560

[21] Appl. No.: 95,130

[22] Filed: Sep. 11, 1987

[51] Int. Cl.[4] ..... C25F 13/00

[52] U.S. Cl. ..... 204/196; 204/228

[58] Field of Search ..... 204/196, 228, 147

[56] References Cited

U.S. PATENT DOCUMENTS

| | | | |
|---|---|---|---|
| 3,830,719 | 8/1974 | Cavil | 204/196 |
| 4,080,272 | 3/1978 | Ferry et al. | 204/147 |
| 4,226,694 | 10/1980 | Baboian et al. | 204/196 |
| 4,311,576 | 1/1982 | Toudo et al. | 204/196 |
| 4,322,633 | 3/1982 | Staerzl | 204/196 |
| 4,351,703 | 9/1982 | Winslow, Jr. | 204/1 T |
| 4,409,080 | 10/1983 | Slough | 204/196 |
| 4,492,877 | 1/1985 | Staerzl | 307/95 |
| 4,510,030 | 4/1985 | Miyashita et al. | 204/196 |
| 4,528,460 | 7/1985 | Staerzl | 307/95 |
| 4,647,353 | 3/1987 | McCready | 204/147 |
| 4,664,764 | 5/1987 | Zofan | 204/147 |

*Primary Examiner*—R. L. Andrews

*Attorney, Agent, or Firm*—Emch, Schaffer, Schaub & Porcello Co.

[57] ABSTRACT

An electronic control circuit for a vehicle cathodic protection system is disclosed. A battery of the vehicle is utilized to supply electrical energy to the circuit. The circuit includes a first voltage comparator which compares the voltage level of the vehicle battery with a predetermined reference level. If the voltage level of the vehicle battery falls below the reference level, the first voltage comparator disables the control circuit so as to prevent an undesirable drain on the vehicle battery form occurring. An oscillator provides a pulsating output signal. When the output pulses from the oscillator are positive, a transistor switch is turned on to cause electric current to flow to one or more sacrificial anodes. When the output pulses are negative, the transistor switch is turned off, thereby preventing electric current from flowing to the sacrificial anodes. Thus, the control circuit is only energized intermittently. A pilot light is responsive to the positive output pulses from the oscillator to generate a visual indication when the control circuit is energized. A temperature regulator is provided to disable the control circuit, by means of a second voltage comparator, when the ambient temperature is too high.

13 Claims, 1 Drawing Sheet

ELECTRONIC CONTROL CIRCUIT FOR A CATHODIC PROTECTION SYSTEM

BACKGROUND OF THE INVENTION

1. Field of the Invention

The present invention relates in general to cathodic protection systems and in particular to an improved electronic control circuit for such a cathodic protection system.

Corrosion is a well known and continuous process which results in the destruction of metals. In order for metal to corrode, there must be a corrosion cell, consisting of a metallic anode, a metallic cathode, and a chemical electrolyte between the anode and the cathode. There must also be an electric potential difference between the anode and the cathode. When this condition occurs, positively charged atoms of the metal leave the surface of the anode and enter the electrolyte as metallic ions. The ions migrate through the electrolyte to the cathode. As a result, corrosion occurs at the anode. Consequently, it will be appreciated that corrosion occurs as a direct result of an electric current passing between two metallic surfaces.

As is well known, vehicles, such as automobiles and boats, are particularly subject to corrosion. This is true because dissimilar metals are generally utilized in the construction thereof. The dissimilar metals inherently create a difference in electric potential therebetween. Also, various chemicals in the air or in water provide the chemical electrolyte between the dissimilar metals. Consequently, portions of the metallic body of the vehicle function as anodes and, therefore, are destroyed by the above described corrosion process.

Cathodic protection systems are well known in the art for retarding the process of corrosion on vehicles. Such systems generally provide one or more sacrificial anodes which are secured to the vehicle. A relatively small electric current is passed through the sacrificial anode to the vehicle. The flow of the electric current raises the relative electric potential of the sacrificial anode above that of the vehicle. Hence, the vehicle acts as the cathode of the corrosion cell described above and, therefore, is less subject to corrosion than would otherwise occur.

2. Description of the Prior Art

U.S. Pat. No. 4,528,460 to Staerzl discloses a control system for cathodically protecting an outboard drive unit from corrosion. The control system includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 4,510,030 to Miyashita et al. discloses a method for the cathodic protection of an aluminum article. The cathodic potential of the article is observed relative to a reference electrode. When the observed cathodic potential approaches the level at which corrosion occurs, the article is electrically connected to a source of electrical voltage to repress the cathodic potential of the article. After a sufficient repression, the article is disconnected from the source, whereby the cathodic potential of the article gradually rises again. Thus, the article is intermittently connected to the source of electric potential.

U.S. Pat. No. 4,322,633 to Staerzl discloses a marine cathodic protection system wherein a reference electrode senses the electric potential near a submerged portion of a drive unit. The signal from the reference electrode is supplied to an operational amplifier, where it is compared with a reference voltage. If the potential sensed by the reference electrode is greater than a predetermined magnitude, the operational amplifier generates an output signal which prevents the flow of electric current to an anode.

U.S. Pat. No. 4,647,353 to McCready discloses an anode structure for an automotive cathodic protection device. It is stated that the device incorporates a pulsating system that allows a vehicle battery (which is utilized as a source of energy for the cathodic protection device) to use its rejuvenating properties more effectively.

U.S. Pat. No. 4,311,576 to Toudo discloses an electric corrosion preventing apparatus including a lamp which is energized when the apparatus is in use.

Other related cathodic protection systems are disclosed in U.S. Pat. Nos. 3,830,719 to Cavil, 4,351,703 to Winslow, Jr., 4,409,080 to Slough, and 4,492,877 to Staerzl.

SUMMARY OF THE INVENTION

The present invention relates to an electronic control circuit for a vehicle cathodic protection system. A battery of the vehicle is utilized to supply electrical energy to the circuit. The circuit includes a first voltage comparator which compares the voltage level of the vehicle battery with a predetermined reference level. If the voltage level of the vehicle battery falls below the reference level, the first voltage comparator disables the control circuit so as to prevent an undesirable drain on the vehicle battery form occurring. An oscillator provides a pulsating output signal. When the output pulses from the oscillator are positive, a transistor switch is turned on to cause electric current to flow to one or more sacrificial anodes. When the output pulses are negative, the transistor switch is turned off, thereby preventing electric current from flowing to the sacrificial anodes. Thus, the control circuit is only energized intermittently. A pilot light is responsive to the positive output pulses from the oscillator to generate a visual indication when the control circuit is energized. A temperature regulator is provided to disable the control circuit, by means of a second voltage comparator, when the ambient temperature is too high.

It is an object of the present invention to provide an improved electronic control circuit for a vehicle cathodic protection system.

It is another object of the present invention to provide such a cathodic protection system which will not undesirably drain the battery of the vehicle.

It is a further object of the present invention to provided such a cathodic protection system which is disabled when in the ambient temperature of the system exceeds a predetermined value.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
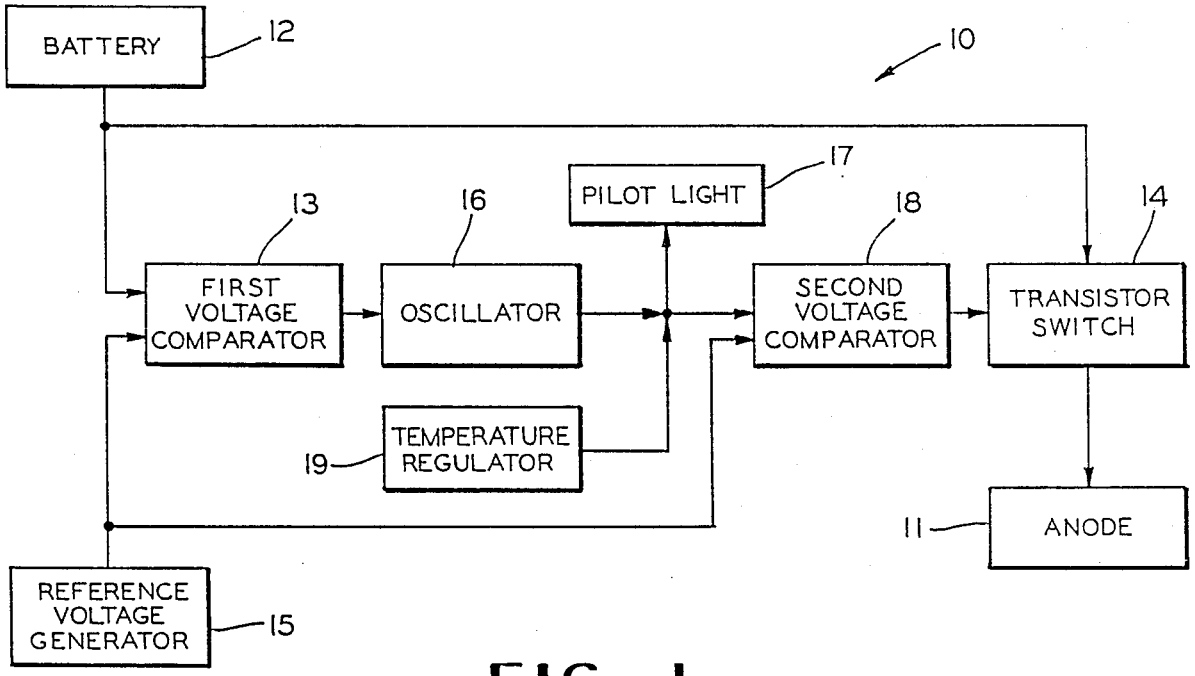
FIG. 1 is a block diagram of an electronic control circuit for a vehicle cathodic protection system in accordance with the present invention.

Referring now to the drawings, there is illustrated in FIG. 1 a block diagram of an electronic control circuit, indicated generally at 10, for a vehicle cathodic protection system in accordance with the present invention. The control circuit 10 is adapted to be connected to one or more conventional anodes 11 (only one is shown) to retard corrosion of the vehicle (not shown) in the manner described above. A battery 12 of the vehicle or other source is connected to supply electrical energy to the control circuit 10. The battery 12 is connected to a first voltage comparator 13 and to one side of a transistor switch 14. The first voltage comparator 13 compares the voltage level generated by the battery 12 with a predetermined reference level provided by a reference voltage generator 15. If the battery voltage is greater than the reference level, the first voltage comparator 13 generates an enabling output signal to energize the rest of the control circuit 10, as will be described in detail below. If the battery voltage is less than the reference level, the first voltage comparator 13 generates a disabling output signal to the rest of the control circuit 10. The reference level is selected to be a minimum voltage level from the battery 12 below which it would be undesirable to operate the control circuit 10. Thus, the control circuit 10 is automatically prevented from draining a low charged battery 12 below a level which would prevent it from starting the vehicle engine.

The output signal from the first voltage comparator 13 is fed to an oscillator 16. When the enabling output signal is generated, the oscillator 16 generates a pulsating output signal which varies between either a positive or negative voltage level. The pulsating output signal is fed to both a pilot light 17 and a second voltage comparator 18. When the pulsating output signal is positive, the pilot light 17 is energized, and the second voltage comparator 18 generates a closing signal to the transistor switch 14. When the pulsating output signal is negative, the pilot light 17 is de-energized, and the second voltage comparator 18 generates an opening signal to the transistor switch 14. The transistor switch 14 is responsive to the closing signal from the second voltage comparator 18 for effectively connecting the battery 12 to the anodes 11. Conversely, the transistor switch 14 is responsive to the opening signal for effectively disconnecting same. A temperature regulator 19 is connected to the output of the oscillator 16, for a purpose to be described below.

Figure 2:
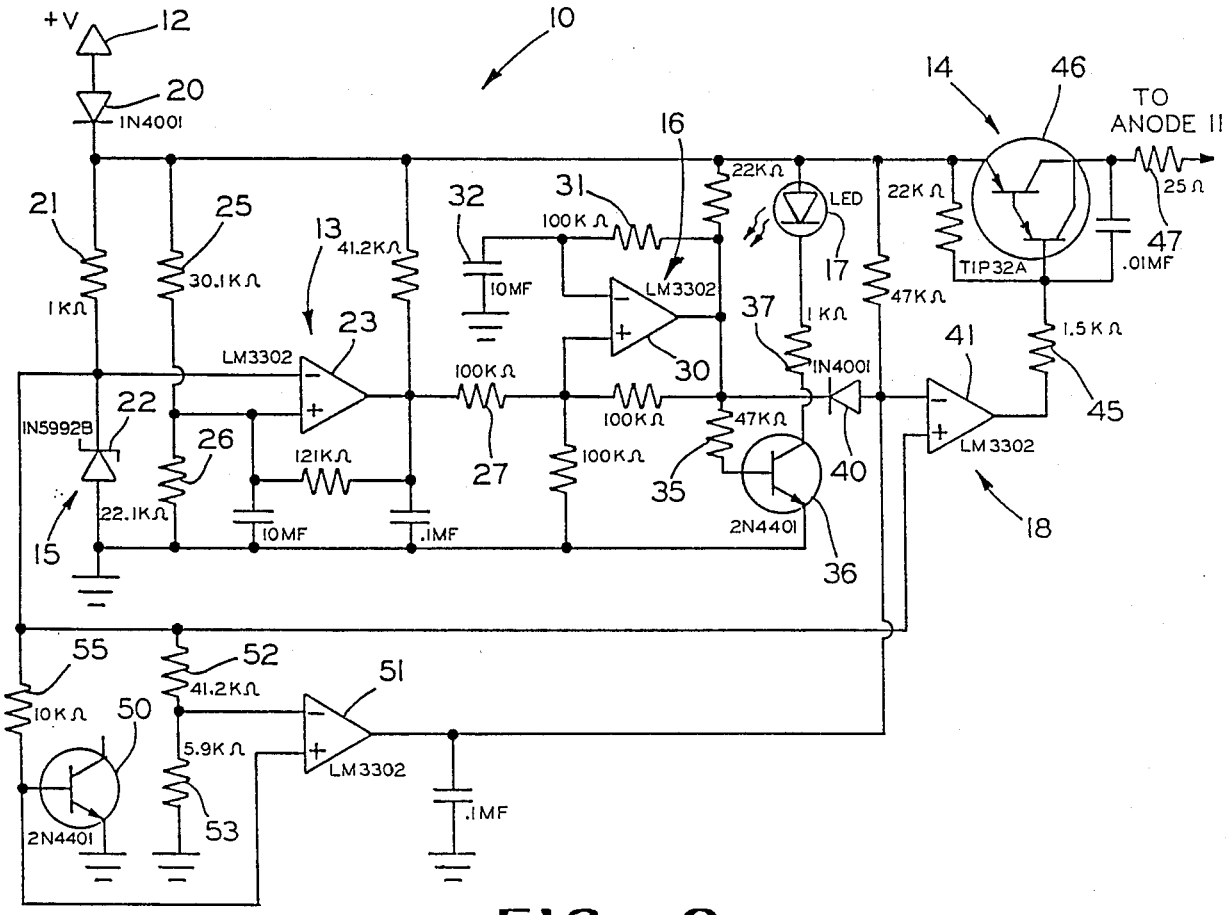
FIG. 2 is an electrical schematic diagram of the electronic control circuit illustrated in FIG. 1.

Referring now to FIG. 2, the structure and operation of the control circuit 10 will be explained in detail. The positive terminal of the battery 12 is connected to the anode of a diode 20. The diode 20 is provided to protect the control circuit 10 from reverse voltage which could be imposed thereon if the negative terminal of the battery 12 (which is illustrated as ground potential in FIG. 2) was mistakenly connected to the anode of the diode 20. The cathode of the diode 20 is connected through a resistor 21 to the cathode of a zener diode 22. The zener diode 22 forms a part of the reference voltage generator 15. The anode of the zener diode 22 is connected to ground potential. The zener diode 22 provides a constant reference voltage differential above ground potential at its cathode.

The cathode of the zener diode is connected to the inverting input of a first operational amplifier 23, which forms a part of the first voltage comparator 13. The non-inverting input of the first operational amplifier 23 is connected to the junction between a pair of resistors 25 and 26. The resistors 25 and 26 are connected between the cathode of the diode 20 and ground potential and, therefore, form a voltage divider. Thus, the voltage level supplied to the non-inverting input of the first operational amplifier 23 is equal to a predetermined fraction of the voltage level at the cathode of the diode 20 and, consequently, of the voltage level of the battery 12.

The first operational amplifier 23 compares the voltage levels at its inverting and non-inverting inputs and generates an output signal in response to whichever voltage level is greater in magnitude. If the voltage level presented at the non-inverting input is greater than the voltage level presented at the inverting input (indicating that the predetermined fraction of the battery voltage is greater than the predetermined reference level set by the zener diode 22), the first operational amplifier 23 will generate a positive voltage output signal. If the voltage level presented at the inverting input is greater than the voltage level presented at the non-inverting input (indicating that the battery voltage is less than such predetermined reference level), the output signal from the first operational amplifier 23 will be a negative voltage. Thus, the first operational amplifier 23 functions as the first voltage comparator 13 to generate a positive output signal when the voltage level of the battery 12 is greater than the predetermined reference level. As will be explained in detail below, the positive output signal from the first operational amplifier 23 is utilized to enable the rest of the control circuit 10 to operate. If the first operational amplifier 23 generates the negative output signal, then it is undesirable to operate the control circuit 10, inasmuch as such operation might overly drain the battery 12 and prevent it from starting the vehicle engine at a desired time.

The output of the first operational amplifier 23 is connected through a resistor 27 to the non-inverting input of a second operational amplifier 30. The second operational amplifier 30 is connected to function as the astable oscillator 16. When the output signal from the first operational amplifier 23 is positive, the output signal from the second operational amplifier 30 oscillates between positive and negative voltage levels. The period of such oscillations is determined by the values of a feedback resistor 31 and a capacitor 32. It has been found to be desirable to select the values of the resistor 31 and the capacitor 32 such that the period of the output signal from the second operational amplifier 30 is approximately two seconds. In other words, such output signal is positive for approximately one second and negative for approximately one second. When the output signal from the first operational amplifier 23 is negative, however, the output signal from the second operational amplifier 30 will always be negative.

The output signal from the second operational amplifier 30 is fed through a resistor 35 to the base of an NPN transistor 36. The collector of the transistor 36 is connected through a resistor 37 to the pilot light 17, which may be a conventional light emitting diode. The emitter of the transistor 36 is connected to ground potential. Assuming that the output signal from the first operational amplifier 23 is positive, the output signal from the second operational amplifier 30 will oscillate as described above. When such output signal is positive, the transistor 36 will be placed in a saturated condition, thereby effectively connecting the resistor 37 to ground potential. Consequently, the light emitting diode 17 will be illuminated because of the effective closed circuit between the battery 12 and ground potential. When the output signal from the second operational amplifier 30 is negative, however, the transistor 36 will be placed in a cut off condition. Therefore, the resistor 37 will not be effectively connected to ground potential. Because of this effective opened circuit, the light emitting diode 17 will not be illuminated. Thus, it can be seen that the light emitting diode 17 will be illuminated only when the output signal from the second operational amplifier 30 is positive.

The output signal from the second operational amplifier 30 is also fed to the cathode of a diode 40. The anode of the diode 40 is connected to the inverting input of a third operational amplifier 41. The non-inverting input of the third operational amplifier 41 is connected to the cathode of the zener diode 22. Thus, the reference voltage level supplied to the inverting input of the first operational amplifier 23 is also supplied to the non-inverting input of the third operational amplifier 41. The third operational amplifier 41 is arranged to function as the second voltage comparator 18. As with the first voltage comparator 13, the output from the second voltage comparator 18 will either be positive or negative, depending upon whether the voltage level supplied to the non-inverting input or the inverting input, respectively, is greater than the other.

The output of the third operational amplifier 41 is connected through a resistor 45 to the base of a PNP Darlington pair 46. The Darlington pair 46 forms the transistor switch 14. The emitter of the Darlington pair 46 is connected to the cathode of the diode 20, while the collector thereof is connected through a resistor 47 to the sacrificial anode 11 illustrated in FIG. 1. When the output signal from the third operational amplifier 41 is a positive voltage, the Darlington pair 46 is placed in a cut off condition, thereby effectively disconnecting the cathode of the diode 20 from the resistor 47. When the output signal from the third operational amplifier 41 is negative, however, the Darlington pair 46 is placed in a saturated condition, thereby effectively connecting the cathode of the diode 20 to the resistor 47.

Ignoring the operation of the temperature regulator 19 of the control circuit 10 for the moment, it can be seen that the Darlington pair 46 of the transistor switch 14 will be turned on so as to effectively connect the cathode of the diode 20 to the resistor 47 when the output signal from the second operational amplifier 30 is positive. It can also be seen that the Darlington pair 46 of the transistor switch 14 will be turned off so as to effectively disconnect the cathode of the diode 20 from the resistor 47 when the output signal from the second operational amplifier 30 of the oscillator 16 is negative. Thus, the transistor switch 14 is effectively closed and opened intermittently as the output signal from the second operational amplifier 30 moves from positive to negative, respectively. Therefore, the sacrificial anode 11 is intermittently connected to the battery 12 to retard corrosion to the vehicle in the manner described above.

As mentioned above, the voltage level supplied to the non-inverting input of the third operational amplifier 41 will remain constant, by virtue of the zener diode 22. The voltage level supplied to the inverting input of the third operational amplifier 41 will oscillate between positive and negative levels, depending upon the output signal from the second operational amplifier 30. However, the junction between the anode of the diode 40 and the inverting input of the third operational amplifier 41 is connected to the temperature regulator 19. The temperature regulator 19 includes an NPN transistor 50 and a fourth operational amplifier 51. The output of the fourth operational amplifier 51 is connected to the junction between the anode of the diode 40 and the inverting input of the third operational amplifier 41. The inverting input of the fourth operational amplifier 51 is connected to the junction of a pair of resistors 52 and 53, which form a voltage divider between the voltage level of the zener diode 22 and ground potential. The non-inverting input of the fourth operational amplifier 51 is connected through a resistor 55 to the zener diode 22. However, the base of the transistor 50 is connected to the junction between the resistor 55 and the non-inverting input of the operational amplifier 51. The collector of the transistor 50 is an open circuit, while the emitter thereof is connected to ground potential. Thus, the resistor 55 and the transistor 50 also form a voltage divider.

The voltage level supplied to the inverting input of the fourth operational amplifier 51 is constant, depending only upon the voltage level determined by the zener diode 22 and the values of the resistors 52 and 53. However, the voltage level supplied to the non-inverting input is variable, depending upon the voltage level determined by the zener diode 22, the value of the resistor 55, and the internal variable voltage differential between the base and the emitter of the transistor 50. This variable voltage differential is determined by the ambient temperature. As the ambient temperature increases, the voltage differential between the base and the emitter of the transistor 50 decreases. Therefore, the voltage level supplied to the non-inverting input of the fourth operational amplifier 51 also decreases. Accordingly, when the ambient temperature is greater than a predetermined temperature level (as determined by the values of the resistors 52 and 53), the output signal from the fourth operational amplifier 51 will be a negative voltage. When the ambient temperature is below such predetermined temperature, the output signal from the fourth operational amplifier 51 will be a positive voltage.

So long as the ambient temperature of the control circuit 10 is less than the predetermined level, the control circuit 10 will operate in the manner described above. This is because the positive output voltage from the fourth operational amplifier 51 does not prevent the oscillating output signal from the second operational amplifier 30 from passing through to the inverting input of the third operational amplifier 41. If the ambient temperature of the control circuit 10 should increase above the predetermined level, however, the negative output voltage from the fourth operational amplifier 51 will clamp the inverting input of the third operational amplifier 41 at such negative voltage and, therefore, prevent the oscillating output signal from the second operational amplifier 30 from passing thereto. Consequently, the output signal from the third operational amplifier 41 will always be a positive voltage, thereby opening the transistor switch 14 to prevent the anode 11 from being effectively connected to the battery 12. As mentioned above, such a situation would only occur when the ambient temperature of the control circuit 10 is so high as to possibly cause damage thereto. Consequently, it would be undesirable to permit the control circuit 10 to continue to energize the anode 11 under such circumstances. When the ambient temperature later falls below the predetermined level, the control circuit 10 will automatically re-start to intermittently energize the anode.

In accordance with the provisions of the patent statutes, the principal and mode of operation of the present invention have been explained and illustrated in its preferred embodiment. However, it must be understood that the present invention may be practiced otherwise than as specifically explained and illustrated without departing from its spirit or scope.

What is claimed is:

1. In a cathodic protection system including a source of electrical energy at a voltage level and at least one sacrificial anode, an improved electronic control circuit comprising:

means for intermittently connecting the course of electrical energy to the anode; and means responsive to the ambient temperature of the control circuit for preventing the source of electrical energy from being connected to the anode when said ambient temperature is greater than a predetermined level.

2. The invention defined in claim 1 wherein, said temperature responsive means includes first and second voltage dividers, said first voltage divider defining a first voltage differential which is relatively constant and said second voltage divider defining a second voltage differential which is variable in accordance with said ambient temperature.

3. The invention defined in claim 1 further including means for generating a predetermined reference voltage level signal and means for generating an enabling signal when the voltage level generated by the source of electrical energy is greater than said predetermined reference voltage level signal.

4. The invention defined in claim 1 wherein said means for generating a predetermined reference voltage level signal includes a zener diode.

5. The invention defined in claim 2 wherein said means for generating an enabling signal includes an operational amplifier connected to said zener diode and the source of electrical energy.

6. The invention defined in claim 1, wherein said means for intermittently connecting includes an astable oscillator means connected to said enabling signal generating means for generating an oscillating output signal only when said enabling signal is generated.

7. The invention defined in claim 6, wherein said means for intermittently connecting further includes a transistor switch means connected to said astable oscillator means for selectively connecting the source of electrical energy to the anode when said oscillating output signal is generated.

8. The invention defined in claim 7 further including means responsive to the ambient temperature of the control circuit for preventing said oscillating output signal from causing said transistor switch means to selectively connect the source of electrical energy to the anode when said ambient temperature is greater than a predetermined level.

9. In a cathodic protection system including a source of electrical energy at a voltage level and at least one sacrificial anode, an improved electronic control circuit comprising:

means for generating a predetermined reference voltage level signal;

means for genereating an enabling signal when the voltage level generated by the source of the electrical energy is greater than said predetermined reference voltage level signal;

means for intermittently connecting the source of electrical energy to the anode in response to the generation of said enabling signal; and means responsive to the ambient temperature of the control circuit for preventing the source of electrial energy from being connected to the anode when said ambient temperature is greater than a predetermined level.

10. The invention defined in claim 9, wherein said temperature responsive means includes first and second voltage dividers, said first voltage divider defining a first voltage differential which is relatively constant and said second voltage divider defining a second voltage differential which is variable in accordance with said ambient temperature.

11. In a cathodic protection system including a source of electrical energy at a voltage level and at least one sacrificial anode, an improved electronic control circuit comprising:

means for generating a predetermined reference voltage level signal;

means for generating an enabling signal when voltage level generated by the source of the electrical energy is greater than said predetermined reference voltage level signal; and means for intermittently connecting the source of electrical energy to the anode in response to the generation of said enabling signal, said means for intermittently connecting including an astable oscillator means connected to said enabling signal generating means for generating an oscillating output signal only when said enabling signal is generated.

12. The invention defined in claim 11, wherein said means for intermittently connecting further includes a transistor switch means connected to said astable oscillator means for selectively connecting the source of electrical energy to the anode when said oscillating output signal is generated.

13. The invention defined in claim 12 further including means responsive to the ambient temperature of the control circuit for preventing said oscillating output signal from causing said transistor switch means to selectively connect the source of electrical energy to the anode when said ambient temperature is greater than a predetermined level.

* * * * *